US006718558B1

(12) United States Patent
Callanta

(10) Patent No.: US 6,718,558 B1
(45) Date of Patent: Apr. 13, 2004

(54) PAINT BALL GAME PELLET SUPPLY BELT WITH RETRACTABLE CLOSURE

(75) Inventor: Leonardo Callanta, Long Beach, CA (US)

(73) Assignee: Joey and JC Corp., Long Beach, CA (US)

( * ) Notice: Subject to any disclaimer, the term of this patent is extended or adjusted under 35 U.S.C. 154(b) by 0 days.

(21) Appl. No.: 10/348,767

(22) Filed: Jan. 22, 2003

(51) Int. Cl.[7] ..... A41F 9/00
(52) U.S. Cl. ..... 2/312; 224/236
(58) Field of Search ..... 2/312–321, 338, 2/311; 224/674, 675, 660, 240, 236, 249, 250, 251, 625, 600, 620, 199, 901, 901.4, 901.8, 904, 919

(56) References Cited

U.S. PATENT DOCUMENTS 2,625,192 A * 1/1953 Kinskie ..... 224/665
4,420,104 A * 12/1983 DiIenno ..... 224/250
5,060,835 A * 10/1991 Payne ..... 224/148.2
5,240,156 A * 8/1993 Sicotte et al. ..... 224/583
5,263,619 A * 11/1993 Shoemaker ..... 224/240
5,624,065 A * 4/1997 Steffe ..... 224/625
6,076,715 A * 6/2000 Easter ..... 224/149
6,158,642 A * 12/2000 Herbage ..... 224/675

* cited by examiner

*Primary Examiner*—Tejash Patel
(74) *Attorney, Agent, or Firm*—Kleinberg & Lerner, LLP; Marshall A. Lerner, Esq.; Finn T. Simmensen, Esq.

(57) ABSTRACT

A belt wearable by a person; a loop formed thereon for receiving an object of predetermined circumference; a flap is securable in a first relation to the belt and to the loop wherein the flap restricts the opening to confine an object of the predetermined circumference within the loop, and displaceable to a second relation to the belt and the loop wherein the opening is passable to allow removal an object of the predetermined circumference from the loop. A retractor is so coupled to the belt and to the flap as to hold the flap proximate the belt when the flap is in the second relation to the belt and to the loop. A retractor stretched between top and bottom edges of the belt. Elastic retractor. Ring coupling the retractor to the flap. Elastic ring. VELCRO® brand closure fastening flap to loop and retractor to belt.

14 Claims, 3 Drawing Sheets

PAINT BALL GAME PELLET SUPPLY BELT WITH RETRACTABLE CLOSURE

BACKGROUND OF THE INVENTION

1. Field of the Invention

The present invention relates to recreational paint ball projectiles and related games and apparatus, more particularly to apparatus for supplying paint balls to paint-ball-projecting apparatus, and especially to a wearable accessory for carrying a container of paint balls while playing a paint ball game.

2. Description of the Related Art

A popular recreational activity has grown up around pneumatic apparatus for delivering at high velocity a small, soft, easily ruptured spherical pellet containing liquid paint. This pneumatic apparatus, commonly referred to as a "paint ball gun," a "paint ball shooter," or, preferably and with non-violent connotations, a "marker," comprises a tube, a chamber, a store of pellets, a loading mechanism for transferring a pellet from the store to the chamber, a reservoir of compressed gas, a valve for delivering gas from the reservoir to the chamber, and a trigger for operating the valve and the loading mechanism. The marker often resembles a side arm—typically, a pistol—having a handle and a rudimentary sight. When the trigger is pulled, the gas propels the pellet from the chamber into the tube and the pellet exits the tube at high velocity. If the pellet strikes a solid object at high velocity, the object will be marked with paint.

This apparatus lends itself to a game of skill and team sport in which several persons, wearing safety devices to protect vulnerable parts of their bodies from being struck by speeding pellets, maneuver at some distance from one another, take cover behind objects, and attempt to score points by marking one another with paint.

The game is sometimes intensely competitive, requiring a participant to aim a marker at an opponent while pursuing, fleeing, dodging, or running for cover. During the game, a participant might discharge between several hundred and one thousand or more pellets. Because a marker typically stores a finite number of pellets, the participant must reload the marker. This is done by pouring pellets from a cylindrical reloading container—known as a "pod"—into the marker. The pod has a snap-closed cap at one end and typically contains between 100 and 150 pellets.

With reference to FIG. 1, a conventional reloading supply belt 45 is worn around the participant's waist. At least one loop 55 is attached to an outer surface of the belt. The loop 55 is configured to hold a pod 53 securely, capped end 75 facing downward, until the participant withdraws the pod 53 from the loop 55. The loop 55 is made of an elastic material. The loop 55 also has a flap 61 which is attached to the belt 45, extends beneath the capped end 75 of the pod 55, and is releasably closed by means of an attachment 67, 69 (typically a VELCRO® brand closure) to the loop 55, thereby preventing the pod 53 from falling out of the loop 55. In order to reload the marker, the participant releases the attachment 67, 69, grasps the capped end 75 of the pod 53, and withdraws the pod 53 from the bottom of the loop 55. In the heat of competition, in haste to re-engage an opponent, a participant after reloading the marker will toss the pod 53 aside rather than return it to the loop 55.

Having opened the flap 61 and discarded the pod 53, the participant becomes vulnerable to a competitive disadvantage which results from the way in which the game is played and from the behavior of the open flap 61 after the pod 53 has been withdrawn from the loop 55. Unless the flap 61 is re-attached to the loop 55, it will swing free and will project downward and rearward from the participant's belt. Out of haste, or of forgetfulness, or because it is inconvenient or distracting to attempt to re-attach the open end of the flap 61 to the loop 55, the participant will resume playing with one or more flaps 61 open. It often happens that even when the participant has taken cover, the flap 61 alone projects into an opponent's line of fire, affording the opponent a chance to score against the participant by marking the participant's flap 61. According to the rules of the game, a point may be scored by marking any part of a participant's body, clothing or equipment.

A participant in this developing sport would obtain a competitive advantage by having a pod-retaining flap which would not protrude when left open after the pod it held had been withdrawn.

SUMMARY OF THE INVENTION

It is an object of the present invention to provide for a recreational paint ball marker reloading belt a pod-retaining flap which does not protrude when left open after the pod it held has been withdrawn.

In accordance with these objects and with others which will be described and which will become apparent, an exemplary embodiment of the pellet supply belt in accordance with the present invention comprises a belt wearable by a person; a loop formed thereon, the loop defining an opening and being capable of receiving an object of a predetermined circumference; and a flap. The flap is securable in a first relation to the belt and to the loop wherein the flap restricts the opening to confine an object of the predetermined circumference within the loop, and displaceable to a second relation to the belt and the loop wherein the opening is passable to allow removal an object of the predetermined circumference from the loop. A retractor is so coupled to the belt and to the flap as to hold the flap proximate the belt when the flap is in the second relation to the belt and to the loop. In a variation on this exemplary embodiment, a VELCRO® brand closure system forms at least one attachment of the retractor to the belt.

In another exemplary embodiment of the pellet supply belt in accordance with the present invention, the loop is formed of a pliable material.

In another exemplary embodiment, the loop is formed of an elastic material.

In another exemplary embodiment, the flap comprises a flap base and the flap base, the belt comprises a belt bottom edge, and the flap base is attached to the belt proximate the belt bottom edge.

In another exemplary embodiment, the flap comprises a flap closure disposed distally thereon, the loop comprises a loop closure fasteningly engageable with and disengageable from the flap closure.

In another exemplary embodiment, the flap closure and the loop closure comprise a VELCRO® brand closure system.

In another exemplary embodiment, the retractor comprises an elastic material.

In another exemplary embodiment, the flap comprises an elastic material.

In another exemplary embodiment, the retractor and the flap are coupled so as to be in elastic tension when the flap, the belt, and the loop are secured in the first relation.

Another exemplary embodiment of the pellet supply belt in accordance with the present invention further comprises a ring medially encircling the retractor and the flap.

In another exemplary embodiment, the ring is formed of an elastic material.

In another exemplary embodiment, the belt comprises a belt top edge, a belt bottom edge, and a belt front surface, the retractor is proximally attached to the belt proximate the belt bottom edge, and the retractor is distally fasteningly engageable with and disengageable from the belt front surface proximate the belt top edge.

In another exemplary embodiment, the retractor is distally fasteningly engageable with and disengageable from the belt front surface proximate the belt top edge by means of a VELCRO® brand closure system.

It is an advantage of the present invention that a participant needs not attend to the re-closing of a pod loop flap after opening the flap and withdrawing the pod.

BRIEF DESCRIPTION OF THE DRAWINGS

For a further understanding of the objects and advantages of the present invention, reference should be had to the following detailed description, taken in conjunction with the accompanying drawing, in which like parts are given like reference numbers and wherein.

DESCRIPTION OF THE PREFERRED EMBODIMENTS

Figure 2:
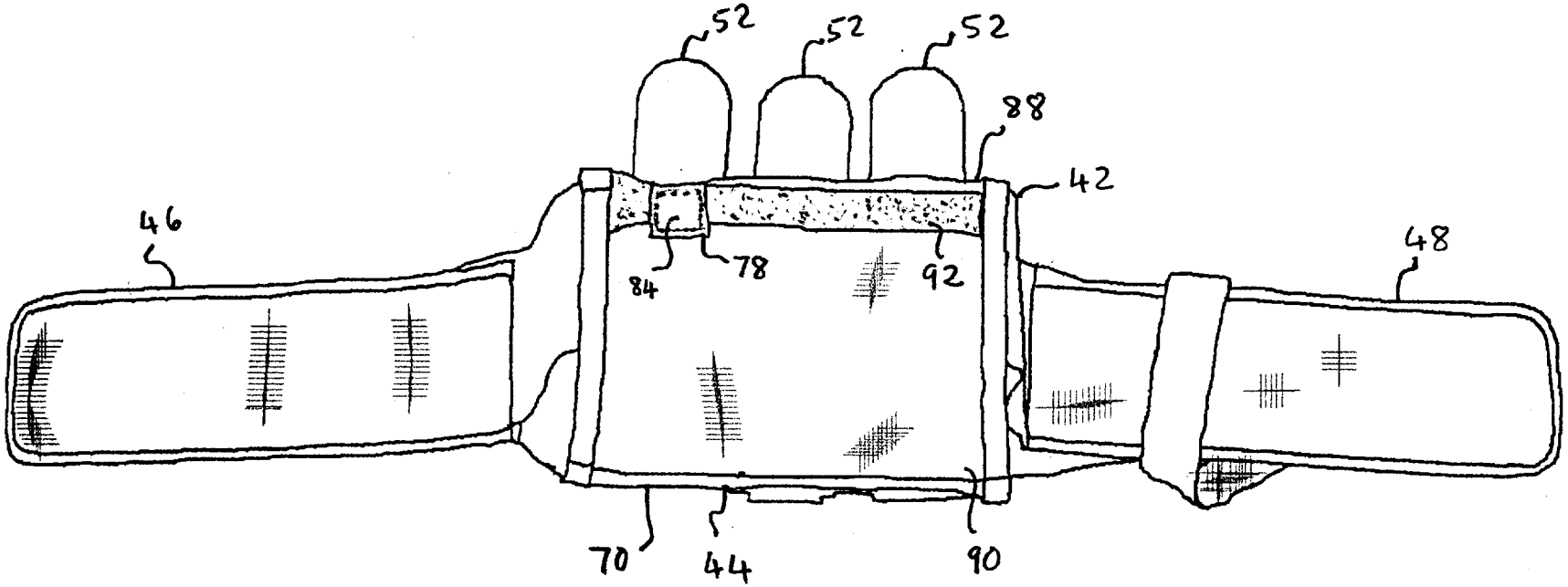
FIG. 2 is a front elevational view of the pellet supply belt in accordance with the present invention.

The invention will now be described with reference to FIG. 2, which illustrates in rearward-looking front elevational view a preferred embodiment of the pellet supply belt having a container support with a retractable closure in accordance with the present invention shown generally by the reference number 40. +The belt 40 comprises a belt right segment 46, a belt left segment 48, and a belt central segment therebetween. The belt central segment comprises a belt top edge 88, a belt bottom edge 70, and a belt front surface 90 on which is disposed a belt front surface closure patch 92. As it is worn, the belt would encircle a person's waist, the belt left segment 48 being fasteningly engaged with the belt right segment 46, the belt central segment snug against the person's lower back. A retractor strap distal portion 78 with a retractor strap distal closure patch 84 is shown disposed in fastening engagement with the belt front surface closure patch 92. Three pods 52 are shown rising above the belt top edge 88. The belt 40 is made of nylon or another suitable material.

Figure 1:
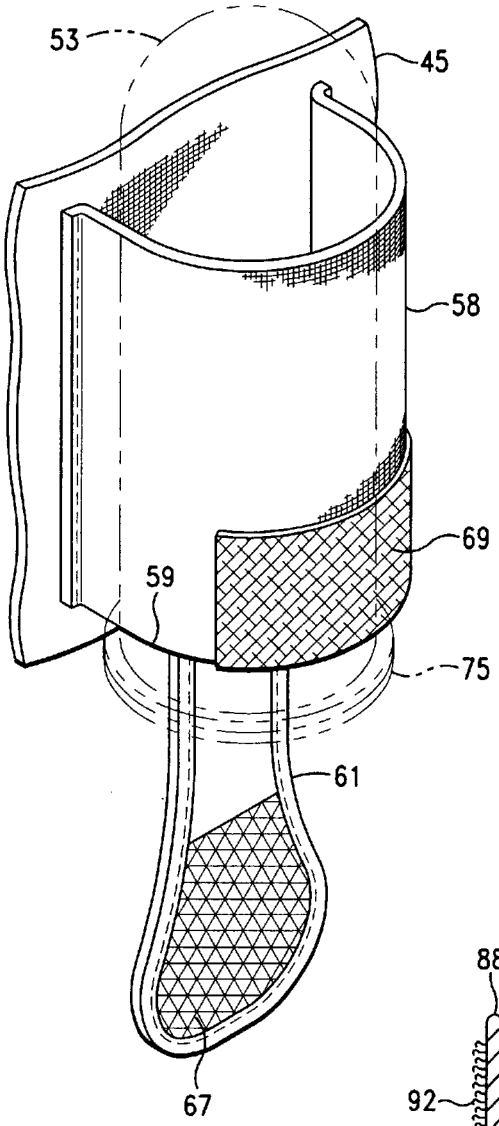
FIG.–1 (PRIOR ART)
FIG. 1 is a perspective view of a conventional pellet supply belt.
Figure 3:
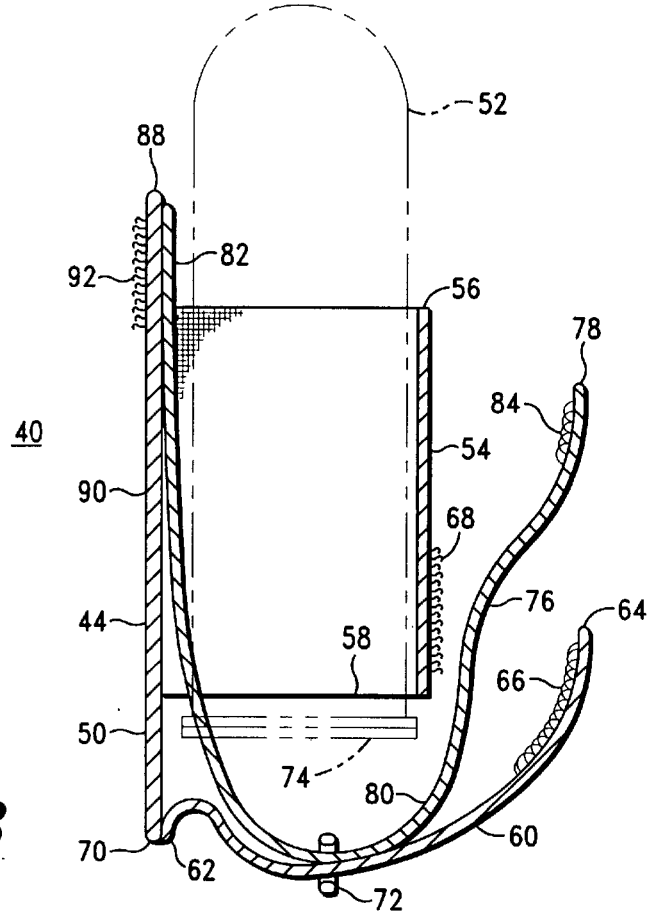
FIGS. 3–5 are side sectional views thereof.

FIG. 3 is a side sectional view of the pellet supply belt in accordance with the present invention. The belt 40 comprises a belt top edge 88, a belt bottom edge 70, a belt front surface 90, and a belt front surface closure patch 92. A stiffening panel 50 which is enclosed within the belt central portion and extends approximately the height and width thereof.

An elastic fabric loop 54 projects rearwardly from the belt central portion and defines a loop top end 56 and a loop bottom end 58. A loop closure patch 68 is disposed on the loop 54. A pod 52 having a pod capped end 74 is shown inserted within the loop 54.

A flap 60 comprises a flap base 62 attached to the belt central portion proximate the belt bottom edge 70, a flap distal portion 64, and a flap medial portion therebetween. Disposed on the flap distal portion 64 is a flap closure patch suitable for fastening engagement with the loop closure patch 68 (a VELCRO® brand closure system is depicted).

A retractor strap 76 comprises a retractor strap base 82 attached to the belt central portion proximate the belt top edge 88, a retractor strap distal portion 78, and a retractor strap medial portion 80 therebetween. Disposed on the retractor strap distal portion 78 is a retractor strap distal closure patch 84 suitable for fastening engagement with the belt front surface closure patch 92 (a VELCRO® brand closure system is depicted).

A ring 72 is disposed about the flap medial portion and the retractor strap medial portion 80, encircling both.

Figure 4:
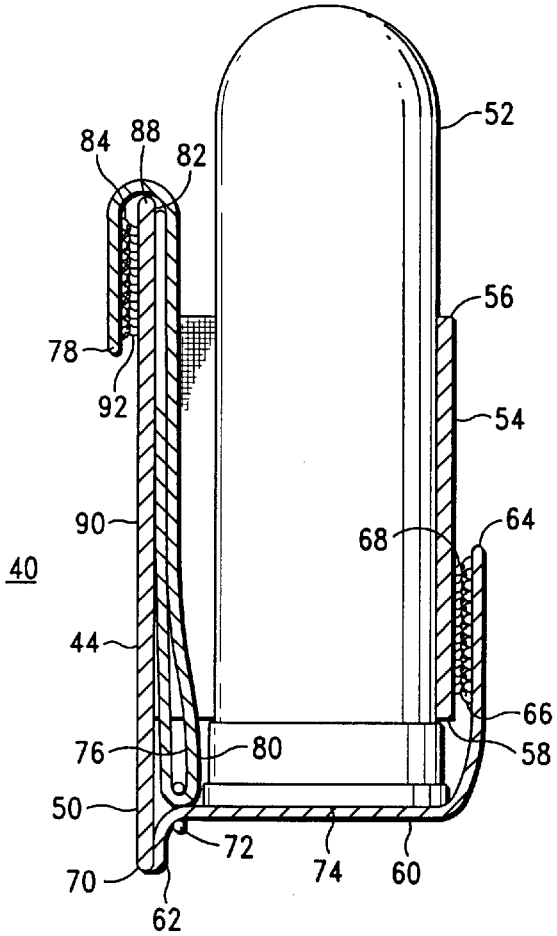

FIG. 4, a side sectional view of the belt in accordance with the present invention as configured for carrying a pod 52, shows the belt central portion, belt top edge 88, belt bottom edge 70, belt front surface 90, a belt front surface closure patch 92, stiffening panel 50, loop 54, loop top end 56, loop bottom end 58, loop closure patch 68, pod 52, pod capped end 74, flap 60, flap base 62, flap distal portion 64, flap medial portion, flap closure patch 66, retractor strap 76, retractor strap base 82, retractor strap distal portion 78, retractor strap medial portion 80, retractor strap distal closure patch 84, and ring 72.

In FIG. 4, the pod 52 fills the loop 54. The flap closure patch 66 is fasteningly engaged with the loop closure patch 68. The flap medial portion extends snugly from the flap base 62, which is attached to the belt 40 proximate the belt bottom edge 70, to the flap distal portion 64, which is fastened to the loop 54 at the loop closure patch 68.

With continued reference to FIG. 4, the retractor strap distal closure patch 84 is fasteningly engaged with the belt front surface closure patch 92. The retractor strap medial portion 80 is formed of an elastic material such as segment of LYCRA® brand elastic fabric. The retractor strap medial portion 80 is stretched from the retractor strap base 82 attached proximate the belt top edge 88, through the ring 72, to the retractor strap distal portion 78 which is engaged with the belt front surface closure patch 92. The ring 72 holds the retractor strap medial portion 80 proximate the flap medial portion, thereby maintaining tension in the retractor strap 76 and in the flap 60.

Figure 5:
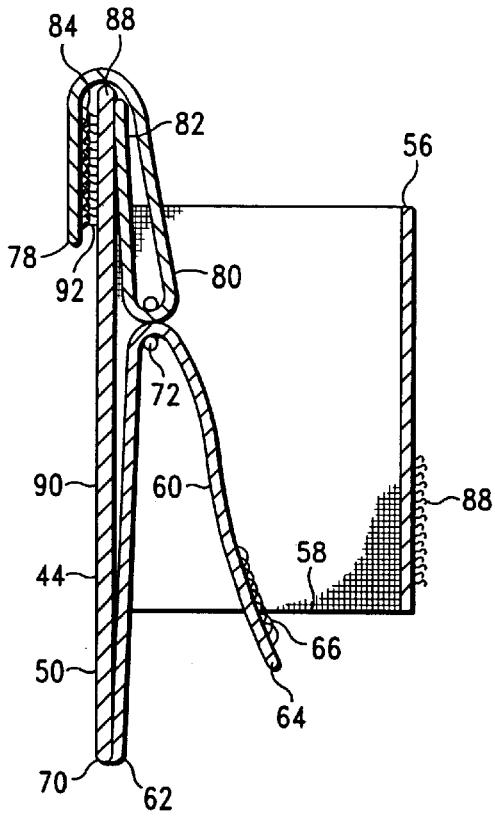

FIG. 5, a side sectional view of the belt in accordance with the present invention as configured for retracting the flap 60 after the pod (not shown) has been withdrawn from the loop 54, shows the belt central portion, belt top edge 88, belt bottom edge 70, belt front surface 90, a belt front surface closure patch 92, stiffening panel 50, loop 54, loop top end 56, loop bottom end 58, loop closure patch 68, flap 60, flap base 62, flap distal portion 64, flap medial portion, flap closure patch 66, retractor strap 76, retractor strap base 82, retractor strap distal portion 78, retractor strap medial portion 80, retractor strap distal closure patch 84, and ring 72.

In FIG. 5, the loop 54 is empty. Therefore, the loop 54, which is formed of an elastic material, is free to contract somewhat and to flatten somewhat against the belt central portion. The flap closure patch 66 has been disengaged from the loop closure patch 68. The retractor strap distal closure patch 84 remains fasteningly engaged with the belt front surface closure patch 92. The ring 72 continues to hold the retractor strap medial portion 80 proximate the flap medial portion. Because the loop 54 is empty and the flap distal portion 64 is unattached to the loop 54, the flap medial portion is free to be pulled upward into the loop 54 and the retractor strap 76 is free to contract to a shorter length. As a result, the distal portion of the flap 60 is prevented from swinging free. Thus, the distal portion of the flap 60 is less likely to protrude and to become a target of opportunity.

It will be appreciated that snaps or other closures may be substituted for the described closure patches, that the closure patches may be repositioned, that there may be some variation in how and where the flap and the retractor strap are attached to the belt, and that the ring may be rigid or flexible and may have a greater or lesser freedom of movement along the flap medial portion and the retractor strap medial portion.

While the foregoing detailed description has described several embodiments of a belt having a container support with a retractable closure in accordance with the present invention, it is to be understood that the above description is illustrative only and not limiting of the disclosed invention. Indeed, it will be appreciated that the embodiments discussed above and the virtually infinite embodiments that are not mentioned could easily be within the scope and spirit of the present invention. Thus, the present invention is to be limited only by the claims as set forth below.

What is claimed is:

1. A pellet supply belt, comprising:

a belt wearable by a person;

a loop formed on said belt, said loop defining an opening that receives an object of a predetermined circumference;

a flap, securable in a first relation to said belt and to said loop wherein said flap restricts said opening to confine an object of said predetermined circumference within said loop, and displaceable to a second relation to said belt and said loop wherein said opening is passable to allow removal of the object of said predetermined circumference from said loop;

a retractor so coupled to said belt and to said flap as to hold said flap proximate said belt when said flap is in said second relation to said belt and to said loop wherein a portion of said flap is substantially positioned within said loop.

2. A pellet supply belt as set forth in claim 1, wherein said loop is formed of a pliable material.

3. A pellet supply belt as set forth in claim 1, wherein said loop is formed of an elastic material.

4. A pellet supply belt as set forth, in claim 1, wherein said flap comprises a flap base, said belt comprises a belt bottom edge, and said flap base is attached to said belt proximate said belt bottom edge.

5. A pellet supply belt as set forth in claim 1, wherein said flap comprises a flap closure disposed distally thereon, said loop comprises a loop closure fasteningly engageable with and disengageable from said flap closure.

6. A pellet supply belt as set, forth in claim 5, wherein said flap closure and said loop closure comprise a hook and loop closure system.

7. A pellet supply belt as set forth in claim 1, wherein said retractor comprises an elastic material.

8. A pellet supply belt as set forth in claim 1, wherein said flap comprises an elastic material.

9. A pellet supply belt as set forth in claim 1, wherein said retractor and said flap are coupled so as to be in elastic tension when said flap, said belt, and said loop are secured in said first relation.

10. A pellet supply belt as set forth in claim 1, further comprising a ring medially encircling said retractor and said flap.

11. A pellet supply belt as set forth in claim 10, wherein said ring is formed of an elastic material.

12. A pellet supply belt as set forth in claim 1, wherein said belt comprises a belt top edge, a belt bottom edge, and a belt front surface, said retractor is proximally attached to said belt proximate said belt bottom edge, and said retractor is distally fasteningly engageable with and disengageable from said belt front surface proximate said belt top edge.

13. A pellet supply belt as set forth in claim 12, wherein said retractor is distally fasteningly engageable with and disengageable from said belt front surface proximate said belt top edge by means of a hook and loop closure system.

14. A pellet supply belt as set forth in claim 1, wherein a hook and loop closure system forms at least one attachment of said retractor to said belt.

* * * * *